United States Patent [19]

Valentine et al.

[11] 4,079,931

[45] Mar. 21, 1978

[54] EXERCYCLE FRAME

[75] Inventors: Henry L. Valentine, Boulder; Louis A. Valentine, Aurora, both of Colo.

[73] Assignee: The Perfection Manufacturing Company, St. Louis, Mich.

[21] Appl. No.: 690,895

[22] Filed: May 28, 1976

[51] Int. Cl.[2] ..... A63B 69/16

[52] U.S. Cl. ..... 272/73; 280/281 R

[58] Field of Search ..... 272/73, 52, 70.3; 280/293, 295, 281 R, 281 LP, 281 W, 281 B; D34/5 K

[56] References Cited

U.S. PATENT DOCUMENTS

| | | | |
|---|---|---|---|
| 3,940,128 | 2/1976 | Ragone | 272/73 |

FOREIGN PATENT DOCUMENTS

| | | | |
|---|---|---|---|
| 779,363 | 1/1935 | France | 272/73 |
| 2,238,585 | 2/1974 | Germany | 272/73 |
| 287,385 | 2/1965 | Netherlands | 272/73 |
| 21,582 of | 1905 | United Kingdom | 272/73 |

OTHER PUBLICATIONS

Nadco Exer-Cisor, The Sporting Goods Dealer, Sept., 1972, p. 200.

Columbia Cycle Exerciser.

Trim Ride 600 by AMF Whitley, Popular Science, Oct., 1962, p. 56.

Walton Exercise Bikes, The Sporting Goods Dealer, Jan., 1973, p. 144.

*Primary Examiner*—Richard C. Pinkham

*Assistant Examiner*—Arnold W. Kramer

*Attorney, Agent, or Firm*—Cohn, Powell & Hind

[57] ABSTRACT

An exercycle frame for an exercycle having a rider's seat, pedals and handle bars in a conventional arrangement, with the pedals driving a drag wheel below the handle bars through a conventional, sprocket-chain connection. The framework, formed of tubular members welded together, includes a longitudinal body tube extending from the rear floor point to frame forks at the front which carry the wheel. The seat structure upstands from this body tube and a pedal-bearing-retainer tube is attached to the underside of this body tube. Transversely disposed stabilizer tubes with extending arms at the base of this framework holds it in an upright, stable position.

2 Claims, 4 Drawing Figures

EXERCYCLE FRAME

The present invention relates to exercising apparatus, and more particularly to an exercising apparatus which simulates bicycle riding. As such, the invention will be hereinafter called an "Exercycle."

Exercycles are commonly used in gymnasiums and they are built in a manner which is suggestive of a conventional bicycle. As such, the exercycle will include a seat and a pair of pedals extended below and forwardly of the seat in about the same seatpedal relationship as is found on a conventional bicycle. The exercycle machines will also include handle bars in an arrangement which is about the same as is the handle bars for a bicycle. The pedals will operate a braking device or a drag. Often, the exercycle will have a front driven wheel which is braked by a drag and the wheel will also connect with a speedometer-odometer arrangement to indicate a measure of both speed and distance which would be covered by a cyclist. The drag is adjustable to apply a selected resistance to the pedaling action to make the exercise either light or very strenuous.

The conventional gymnasium exercycle is carried upon a high quality framework which renders the unit too expensive for the ordinary individual to own. Nevertheless, many individuals do like this type of exercise and would have a unit in their home, if they could obtain a light-weight, low-cost exercycle. Naturally, such an exercycle would have to be of good quality material and designed to withstand the use and even abuse to which such an apparatus is put. The present invention was conceived and developed with this and other considerations in view. It was recognized that the actual bicycle components, such as pedals, were easily available. However, the problems and the expense for obtaining a neat appearing, rigid and stable unit were concerned with the framework. If built in a flimsy or in an improper manner, vibration and rough usage would quickly damage the frame. The present invention thus resides in the construction of an improved and simplified framework for an exercycle in an arrangement having only the essential components to carry the exercycle apparatus.

It follows that an object of the invention is to provide a novel and improved exercycle which is neat appearing, light in weight and is so economical that the average person can afford one.

Another object of the invention is to provide a novel and improved exercycle formed of selected standard bicycle parts which are mounted upon a framework in such a manner as to produce a surprisingly rugged and sturdy unit adapted to withstand considerable rough usage over a long period of time without being damaged or destroyed.

Another object of the invention is to provide a framework for an exercycle which is exceedingly simple in design but of a sturdy, rugged construction which though light in weight, will not jump, nor chatter, nor easily tip over.

Another object of the invention is to provide a novel and improved exercycle of such a simple, fundamental design as to present a desirable appearing unit which is well accepted by the general public.

With the foregoing and other objects in view, ourpresent invention comprises certain constructions, combinations and arrangements of parts and elements as hereinafter described, defined in the appended claims, and illustrated in preferred embodiment by the accompanying drawing in which:

Figure 1:
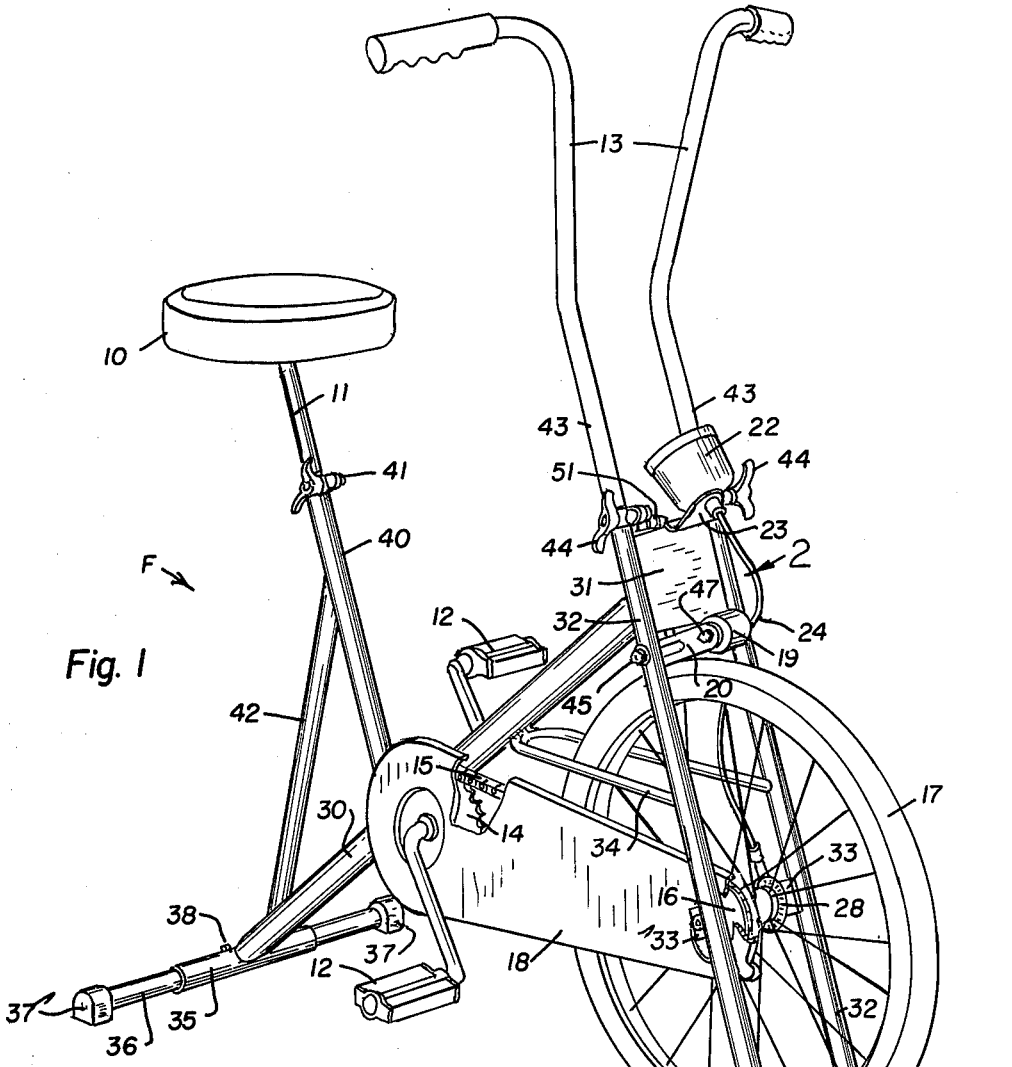
FIG. 1 is a perspective view of an exercycle constructed according to the principles of the invention, the exercycle being viewed as from the front right hand side of the unit.
Figure 2:
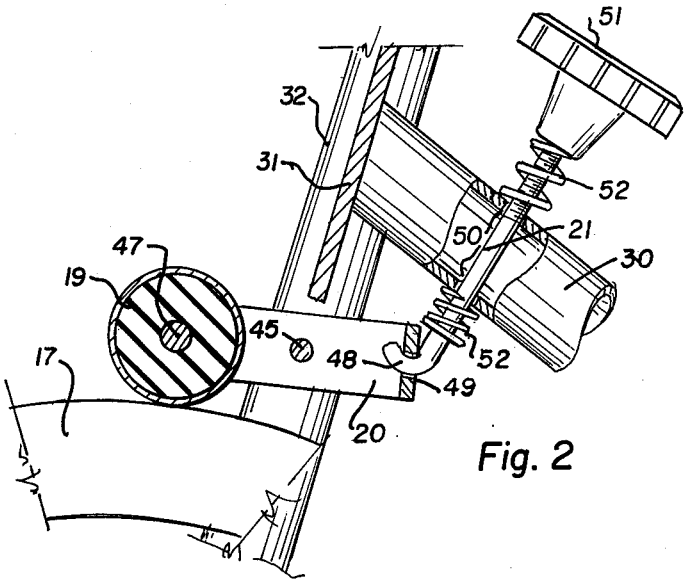
FIG. 2 is a fragmentary sectional detail as taken from the indicated arrow 2 at FIG. 1 to illustrate components not shown at FIG. 1.
Figure 3:
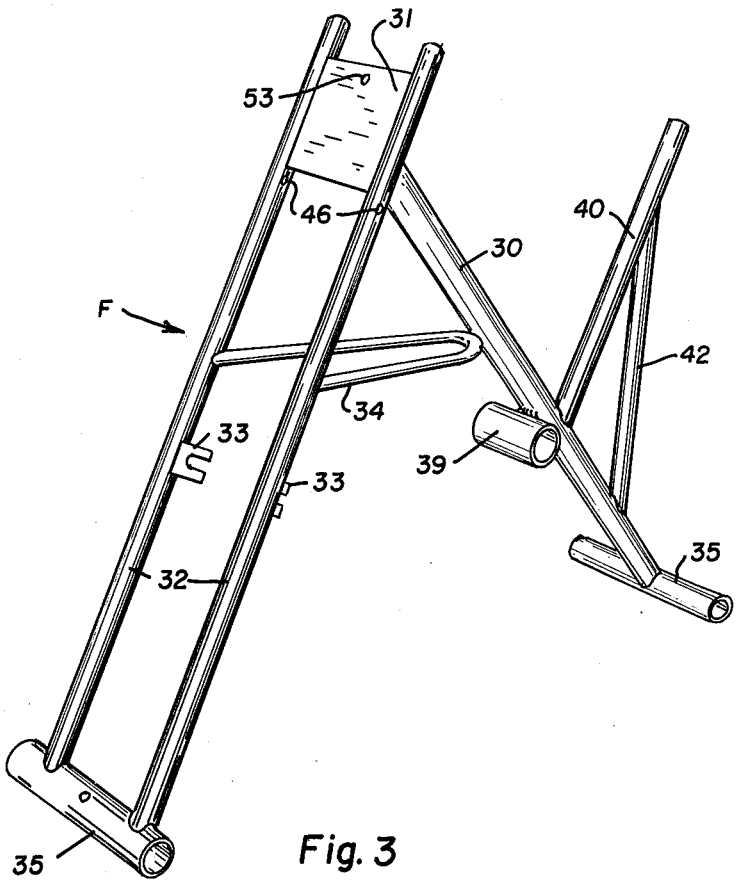
FIG. 3 is a perspective view of the exercycle framework per se, as viewed from the front left hand side of the unit.

Referring more particularly to FIG. 1 of the drawing, the exercycle depicted therein is similar to exercycles found in a gymnasium. However, the unit is carried upon a simplified, tubular framework F hereinafter described in detail. The framework supports a seat 10 carried upon an upright rod 11, the same as a standard bicycle seat. Pedals 12 are mounted in a suitable bearing retainer on the frame, hereinafter described, at a location which is below and forwardly of the seat 10. Handle bars 13 upstand from the framework in front of the seat. These components, the seat, pedals and handle bars, are located essentially the same as they would be on a bicycle. The pedals 12, conventional bicycle pedals, carry a sprocket 14 at their central axle shaft. The sprocket, in turn, carries a forwardly extended chain 15. The chain 15 extends about a driven sprocket 16 mounted upon the axle of a front wheel 17. The front wheel 17, which may be a standard bicycle wheel, is located directly below the handles 13 between frame forks hereinafter described and in a position which would correspond to the position of the front wheel of a standard bicycle. The sprockets 14 and 16 and the chain 15 are enclosed in a cover 18 to provide a neat, safe arrangement of these components.

A drag roller 19 engages the wheel 17 and it is mounted upon a rocker frame 20 to be pulled against the wheel 17 by an adjustable pull rod 21 as hereinafter further described. To complete the exercycle, a speedometer-odometer 22 is mounted upon a bracket 23 which, in turn, is carried upon the frame F between the handle bars at a location easy for an exercycle operator to view. The odometer cable 24 extends from this unit 22 to a plate gear 28 at the hub of the wheel 17.

The framework F for this unit consists of a group of tubular members which are welded together as a rigid, unitary structure. The primary member is a longitudinal body tube 30 which inclines upwardly and forwardly from a floor point at the rear end of the unit and to an upright, rectangular connector plate 31 near the front of the unit above the front wheel 17. The connector plate 31 is disposed between a pair of upright, laterally-spaced frame forks 32 which include at a small angle forwardly and downwardly from the connector plate to the floor of the unit. The frame forks have finger lugs 33 at an intermediate location, at their forward sides to hold the axle of the front wheel 17 much in the same manner as a conventional bicycle wheel is held in the forks of a standard frame. The body tube and the frame forks thus form a skewed A-frame, when viewed from the side of the unit, and a U-shaped, horizontally disposed wheel guard 34 extends rearwardly from the frame forks to connect with the body tube to form the crossbar of the A. Not only does the wheel guard protect a rider of the exercycle, it also enhances the rigidity of the unit.

The lower ends of the body tube 30 and the frame forks 32 are finished off by front and rear, transverse, comparatively short, horizontal, stabilizer tubes 35. Each stabilizer tube telescopically carries a longer stabilizer arm 36 and resilient foot blocks 37 are affixed to each end of each arm. A lock screw 38 at the center of each stabilizer tube locks the stabilizer arms 36 in position. Accordingly, the exercycle will be supported upon the four foot blocks 37 when it is in operation. When it is to be packaged or stored, the stabilizer arms may be removed to reduce the width of the unit.

The inclined body tube 30 is proportioned to connect with the plate 31 between the frame forks 32 above the wheel as described. The inclination is such that the body tube is immediately above the center shaft of the pedals 12 and a short, transverse pedal-bearing-retainer tube 39 is welded to the underside of the body tube. The socket within the pedal-bearing-retainer tube is of a standard construction to receive the center bearings of a bicycle pedal and need not be described further.

As in a standard bicycle, the supporting rod 11 of the seat 10 is normally inclined forwardly and downwardly from the seat and is adapted to be held in a tubular retainer. A seat retainer tube 40 upstands from the body tube 30 at a proper inclination to snugly receive this rod 11. A lock clamp 41 at the top of this retainer tube 40 will secure the rod 11 at any desired position for adjustment of the seat 10. The seat retainer tube, as welded to the top of the body tube, is sufficiently rigid against any ordinary lateral strain which may be imposed upon it. However, a strut tube 42 extends from a point near the top of the retainer tube rearwardly and downwardly to connect with the body tube to provide a reinforcement to resist the rearward pressure which is sometimes imposed upon a bicycle seat when the rider is pedalling vigorously.

The top end of each frame fork 32 is open and is proportioned to telescopically receive the base of a handle bar 13. The handle bars 13, though conventional, are of a specialized type, each being an individual unit, and the two comprise a pair, that is, left hand and right hand units. Each handle bar will include a downwardly extended, rod-like base 43 which fits into the top of the frame forks 32 as best illustrated at FIG. 1. Each handle bar is securely held in place by lock clamps 44 at the top of the frame forks 32. Accordingly, the handle bars 13 may be raised, lowered and rotated to any desired position.

Figure 4:
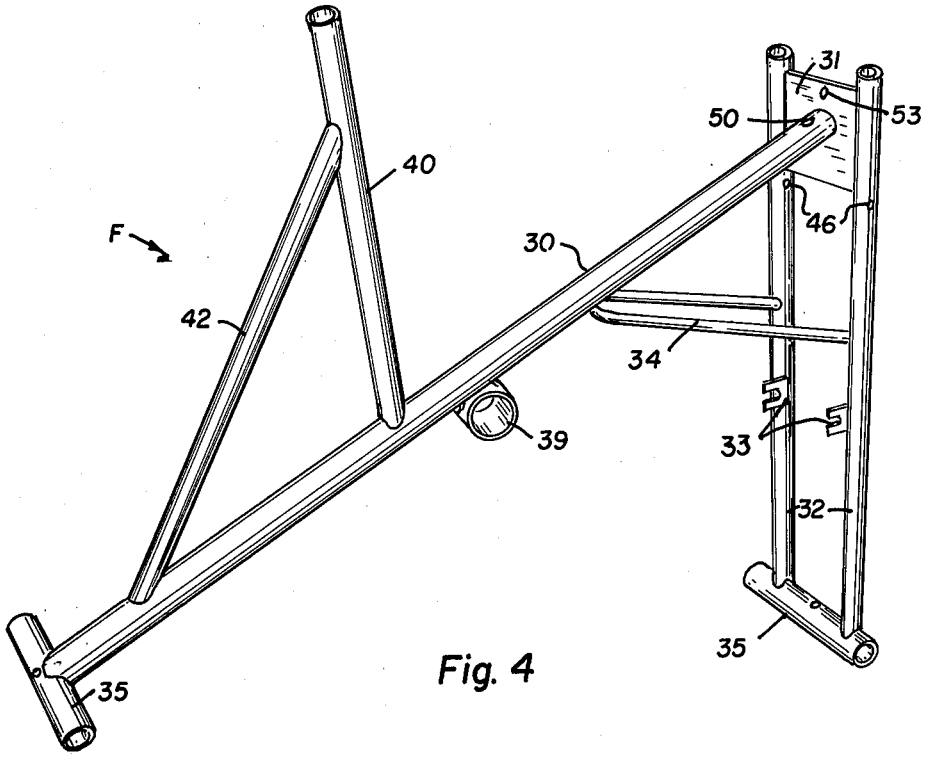
FIG. 4 is a perspective view of the framework as from the rear, right hand side of the unit.

The connector plate 31, a rectangular plate has its side edges aligned with and welded to the frame forks 32 and the end of the body tube 30 abuts against this plate as best shown at FIG. 4. It is located a short distance above the top of the wheel 17 to permit the rocker frame 20 to be positioned between the bottom of this plate 31 and the top of the wheel 17. The rocker frame is carried upon a transverse rocker shaft 45 which extends through it and through each of the frame forks 32. Suitable holes 46 are provided in the frame forks for this purpose. The rocker frame is a U-shaped member with a roller 19 being at the forward end, mounted upon a shaft 47 between the legs of the rocker. The rocker shaft 45 is located near the center of the legs of this rocker and the tension adjuster rod 21 is at the crotch of the rocker. The tension adjuster rod 21 is a threaded rod having a hook 48 at the lower end which fits into a socket 49 in the crotch of the rocker frame 20. Thence, the rod 21 extends upwardly and through holes 50 in the body tube 30. A tension knob 51 is threaded at the top of this rod 21 to pull it upwardly and springs 52, on this rod at the topside and underside of the body tube 30, permit resilient movement of the unit. It is to be noted that the pressure of the drag roller 19 against the wheel creates a drag as the wheel is rotated and the intensity of this drag is easily adjustable.

The speedometer-odometer 22 is a standard unit carried in a cup-like container which may be held in place by the bracket 23 at the underside of the container as illustrated. This bracket, a flat plate, is affixed to the top edge of the connector plate 31 in any suitable manner, preferably by folding an edge of the bracket 23 so that it may be bolted in place, in a hole 53 provided in the connector plate for that purpose.

The foregoing description exemplifies the improved frame structure for an exercycle. The body tube 30, as illustrated, is larger and stronger than the other tubular members since it must function as a beam to carry the weight of the rider. The other tubes, stressed more in compression or tension, can be made of lighter tubing. The basic components making up the exercycle can be easily attached to or removed from this frame and the entire unit may be carried in a surprisingly compact package for shipment an/or storage.

We have now described our invention in considerable detail. However, it is obvious that others skilled in the art can build and devise alternate and equivalent constructions which are nevertheless within the spirit and scope of our invention. Hence, we desire that our protection be limited, not by the constructions illustrated and described, but only by the proper scope of the appended claims.

What is claimed is:

1. A frame for an exercycle of the type having a seat, pedals and a handle bar in an arrangement similar to that found on a bicycle, and with the pedals connecting with a wheel at the front of the unit beneath the handle bars, said frame including in combination therewith:

(a) a single longitudinally extended, continuous body tube inclined from the floor level at the rear of the unit upwardly and forwardly to a point above the aforesaid front wheel;

(b) a pair of laterally, spaced-apart frame forks connecting with the front end of the body tube to extend downwardly and forwardly therefrom to the floor level;

(c) a rear, transverse stabilizer tube at the floor level end of the body tube;

(d) a front transverse stabilizer tube at the bottom of the frame forks;

(e) a tubular member upstanding from and connected to the top of the continuous body tube to carry a seat thereabove;

(f) a transverse pedal-bearing-retainer tube secured to the underside of the continuous body tube;

(g) means to support a wheel between the frame forks; and (h) means to support handle bars within and above the frame forks.

2. A frame for an exercycle of the type having a seat, pedals and a handle bar in an arrangement similar to that found on a bicycle, and with the pedals connecting with a wheel at the front of the unit beneath the handle bars, said frame including in combination therewith:

(a) a single longitudinally extended, continuous body tube inclined from a rear end at the floor level at the rear of the unit upwardly and forwardly to a front end above the said front wheel, (b) a pair of laterally, spaced-apart frame forks inclined from the floor level at the front of the unit upwardly and rearwardly to the front end of the continuous body tube, (c) a plate mounted between the frame forks and attached to the front end of the continuous body tube, (d) a rear transverse stabilizer tube attached to the rear end of the continuous body tube, (e) a front transverse stabilizer tube attached to the bottom of the frame forks, (f) a transverse pedal-bearing-retainer tube secured to the underside of the continuous body tube, (g) a substantially horizontal U-shaped wheel guard, with the end of each leg portion of the wheel guard connected to a frame fork below the connection of the continuous body tube with the fork plate, and with the bight of the wheel guard connected to the underside of the continuous body tube between the pedal-bearing-retainer tube and the fork plate, (h) a tubular member upstanding from and connected to the top of the continuous body tube, the tubular member being inclined rearwardly, and adapted to carry a seat, and (i) a strut tube having one end fixed to the tubular member and the other end fixed to the top of the continuous body tube, the strut tube being inclined downwardly and rearwardly from said one end to the said other end.

* * * * *

UNITED STATES PATENT OFFICE
CERTIFICATE OF CORRECTION

Patent No. 4,079,931 Dated March 21, 1978

Inventor(s) HENRY L. VALENTINE et al

It is certified that error appears in the above-identified patent and that said Letters Patent are hereby corrected as shown below:

In the heading of column 1 of the front page, paragraph [73], cancel the address of the Assignee "St. Louis, Mich." and substitute -- St. Louis, Mo.--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*